US005417303A

United States Patent [19]

Bell

[11] Patent Number: 5,417,303

[45] Date of Patent: May 23, 1995

[54] SYSTEM AND METHOD FOR EXTENDING A SAFETY LINE OVER AN ELECTRICAL TRANSMISSION TOWER

[76] Inventor: Michael Bell, 1705 Triumphe Way, Warrington, Pa. 18976

[21] Appl. No.: 33,670

[22] Filed: Mar. 16, 1993

[51] Int. Cl.[6] ..... E04G 5/00; A47L 3/00

[52] U.S. Cl. ..... 182/129; 182/3; 182/5

[58] Field of Search ..... 187/129, 10, 189, 100, 187/5-11, 9, 3

[56] References Cited

U.S. PATENT DOCUMENTS

| | | | |
|---|---|---|---|
| Re. 30,072 | 8/1979 | Kleine et al. | 182/5 X |
| 287,881 | 11/1883 | Smith | 182/10 X |
| 4,037,824 | 7/1977 | Whitmer | 182/3 X |
| 4,256,199 | 3/1981 | Sellards | 182/11 |
| 4,347,914 | 9/1982 | Gary | 182/7 X |
| 4,703,832 | 11/1987 | Fontenot | 182/100 |
| 4,790,410 | 12/1988 | Sharp et al. | 182/3 X |
| 5,105,907 | 4/1992 | Lebow | 182/191 X |
| 5,224,427 | 7/1993 | Riches et al. | 182/3 X |

FOREIGN PATENT DOCUMENTS

| | | | |
|---|---|---|---|
| 2615742 | 12/1988 | France | 182/3 |
| 2241257 | 8/1991 | United Kingdom | 182/9 |
| 2256002 | 11/1992 | United Kingdom | 182/3 |

*Primary Examiner*—Karen J. Chotkowski
*Attorney, Agent, or Firm*—Caesar, Rivise, Bernstein, Cohen & Pokotilow, Ltd.

[57] ABSTRACT

A system and method of use for attaching a safety rope to an elevated portion of a tower, e.g., an electric power transmission tower, so that the rope extends along the tower's leg from the elevated portion to a lower portion, e.g., the ground, to enable a worker may be secured to the rope by a safety device, e.g., a rope grab, to protect the worker from a fall. The system comprises an air rifle for shooting a projectile having a light weight flexible filament secured to it over the elevated portion of the tower, the safety rope, and plural rope-retaining gates. Once the projectile has been shot over the tower to carry the filament over the elevated portion the safety rope is connected to the filament and pulled over the elevated portion of the tower. The safety rope is then secured in place extending vertically between the elevated portion and the ground. Plural gates are mounted on the tower's leg at spaced locations therealong to hold the safety rope close to the tower leg so that it cannot flap or blow around in the wind. A worker can then attach a safety device on the rope and climb up the tower, while being protected from a fall therefrom.

8 Claims, 3 Drawing Sheets

FIG. 2
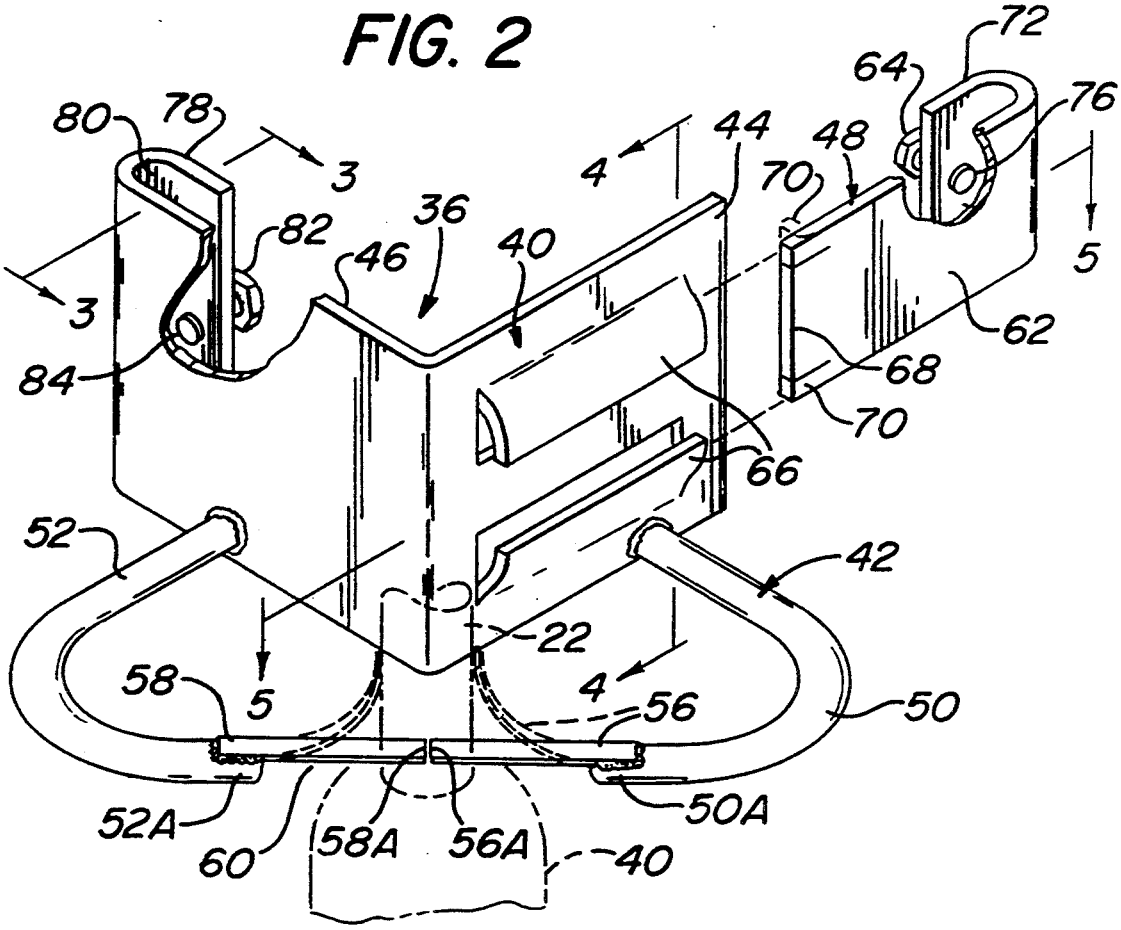
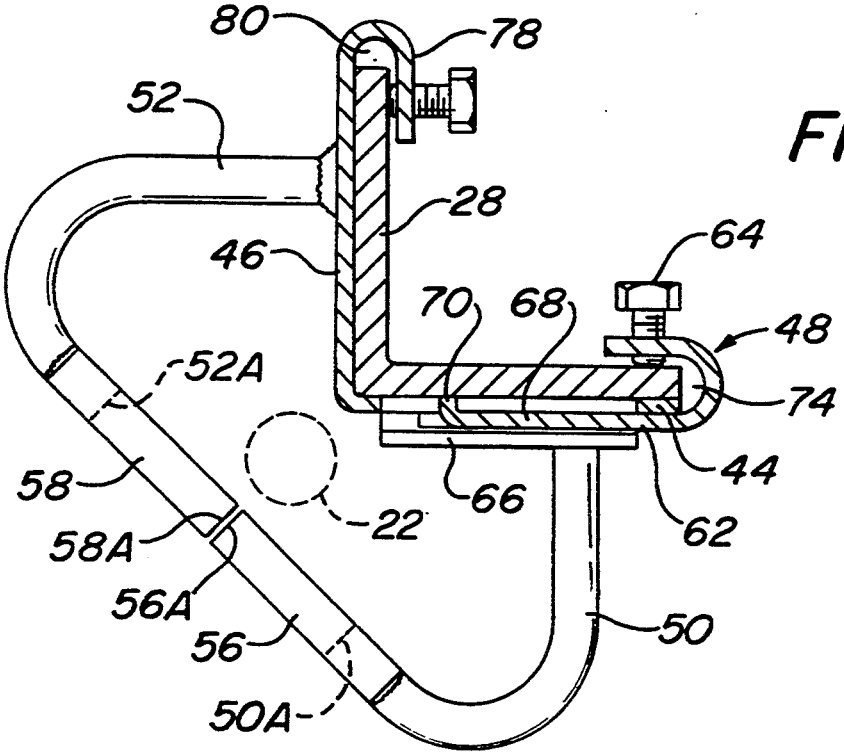
FIG. 5

SYSTEM AND METHOD FOR EXTENDING A SAFETY LINE OVER AN ELECTRICAL TRANSMISSION TOWER

BACKGROUND OF THE INVENTION

This invention relates generally to safety apparatus and more particularly to apparatus and methods of use of extending a safety line over an elevated structure, such as an electrical transmission tower.

With the imposition of laws and regulations regarding the protection of workers from falling off of elevated structures, the electrical utility industry is faced with the task of providing protection for workers on electrical transmission towers. At present there are a multitude of power transmission towers, each of which normally ranges from seventy five (75) feet (22.9 meters) to two hundred and fifty (250) feet (76.2 meters) in height, in the United States which need periodic servicing. In order to reach the cross arms which support the transmission lines, and which are located adjacent the top of the tower the worker typically climbs the tower using the "free climbing" technique, i.e., the worker climbs up the tower using structural features of the tower itself for foot support. This action exposes the workers to severe injuries or death if they should fall.

In order to provide for fail-safe fall protection it has been proposed to permanently install a steel rail or cable on the tower so that a fall prevention safety device, e.g., a rope grab, may be attached thereto. The worker can then be secured to the safety device via a harness or safety belt and a lanyard, e.g., a shock prevention lanyard. While the use of permanent rails or cables does offer an effective means for preventing worker falls its attendant costs are prohibitive.

Thus, a need presently exists for a system which is low in cost and easy to install on a transmission tower to provide a means for protecting workers on the tower from a fall.

OBJECTS OF THE INVENTION

Thus, it is a general object of this invention to provide a system of components which meets that need.

It is a further object of this invention to provide a system of components which overcomes the disadvantages of the prior art.

It is still a further object of this invention to provide a low cost system of components for attaching a safety rope to an elevated structure to protect workers on the structure from a fall.

It is yet a further object of this invention to provide a method for attaching a safety rope to an elevated structure to protect workers on the structure from a fall.

SUMMARY OF THE INVENTION

These and other objects of this invention are achieved by providing a system and method of use for attaching a safety rope to an elevated portion of a tower, with the rope extending from the elevated portion of the tower to a lower portion, e.g., the ground, so that a worker may be secured to the rope by a safety device to protect him/her from falling. The tower can be any type of structure, e.g., an electrical power transmission tower, comprising at least one leg extending from adjacent the elevated portion to adjacent the lower portion.

The system basically comprises catapulting means, a projectile having a light weight elongated flexible filament secured thereto, a safety rope, and at least one gate means. The catapulting means, e.g., an air rifle, is arranged for catapulting the projectile, e.g., a dart-like member, over said elevated structure so that the projectile with the filament trailing therebehind drops to a position adjacent the lower portion of the tower. The safety rope is coupled to the filament and is pulled by the filament over the elevated portion and secured in place adjacent the tower leg between the elevated portion and the lower portion.

The gate means is securable to the tower leg and includes an openable gate for releasable receipt of the safety rope therein to hold it in place adjacent the tower leg.

DESCRIPTION OF THE DRAWINGS

Other objects and many attendant features of this invention will become readily appreciated as the same becomes better understood by reference to the following detailed description when considered in connection with the accompanying drawings wherein:

FIG. 2 is an enlarged isometric view of one component of the system shown in FIG. 1;

FIG. 5 is a sectional view taken along line 5—5 of FIG. 2.

DETAILED DESCRIPTION OF THE PREFERRED EMBODIMENTS

Figure 1:
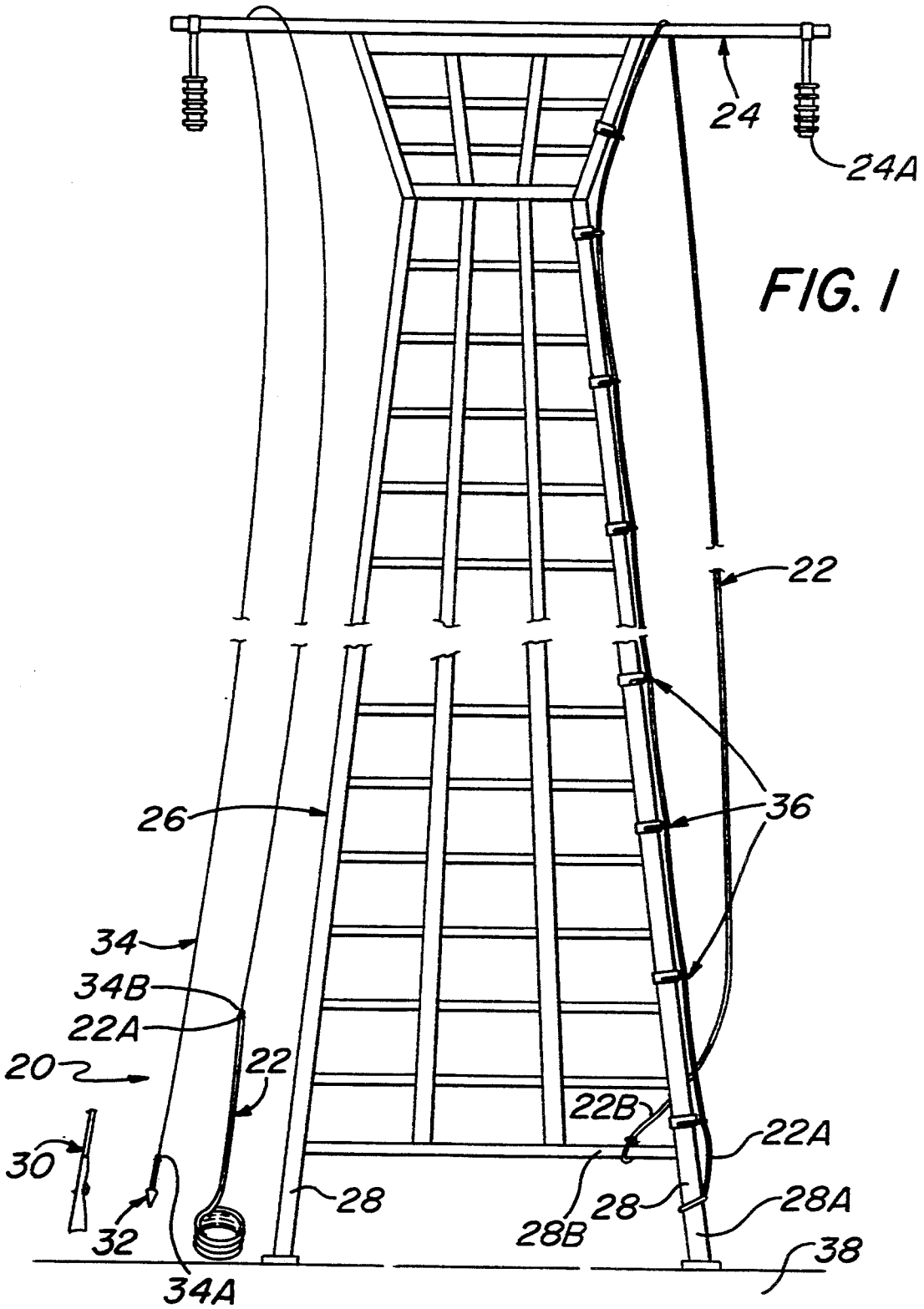
FIG. 1 is a front elevational view of system constructed in accordance with this invention shown in used on a conventional electric power transmission tower.
Figure 3:
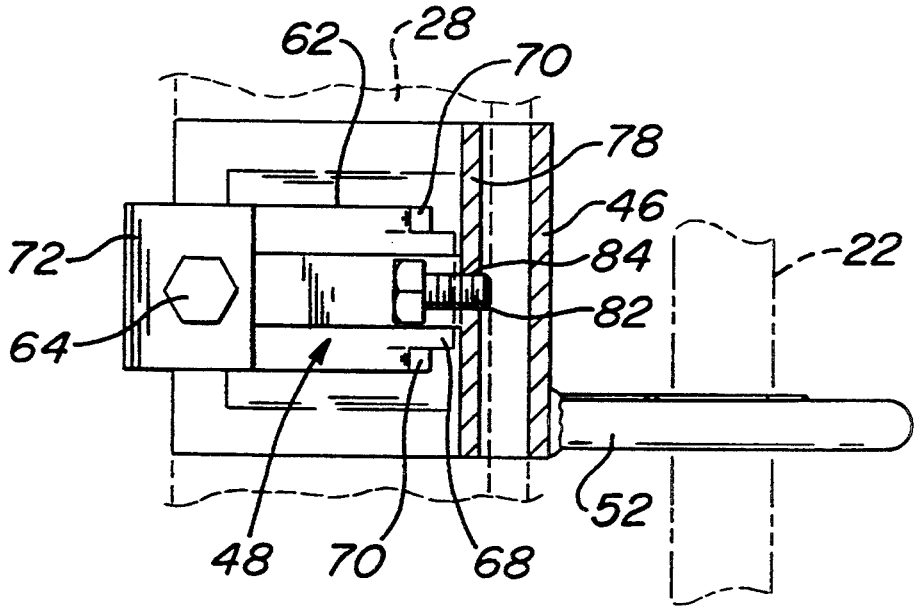
FIG. 3 is a sectional view taken along line 3—3 of FIG. 2.
Figure 4:
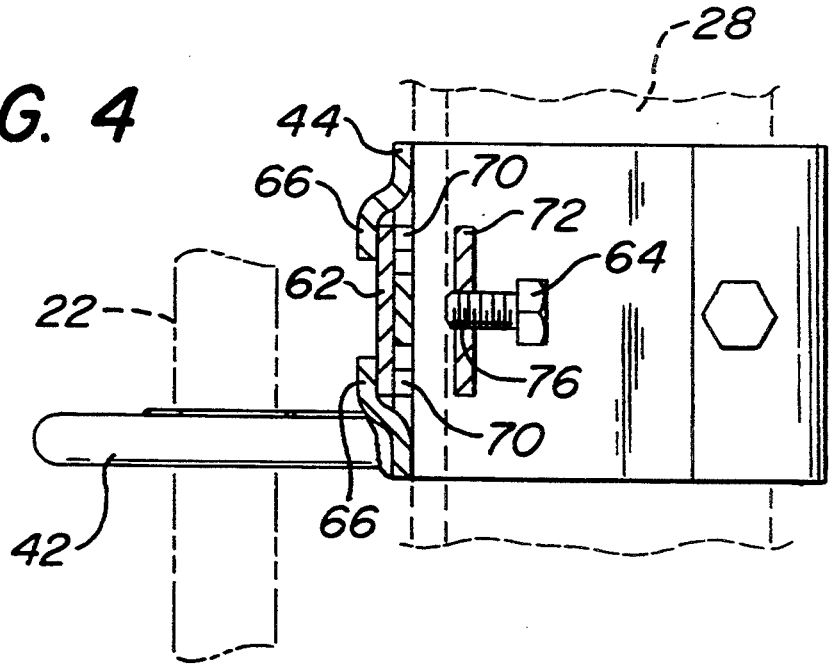
FIG. 4 is a sectional view taken along line 4—4 of FIG. 2.

Referring now to the various figures of the drawing wherein like reference characters refer to like parts, there is shown at 20 in FIG. 1, a system constructed in accordance with this invention for attaching a conventional safety line or rope onto an elevated structure, such as the cross bar 24 of a conventional electrical power transmission tower 26, so that a worker (not shown) can be secured to that line via fall prevention equipment, e.g., a rope grab, lanyard and harness or safety belt, to protect the worker from a fall off of the structure.

Before describing the system 20 a brief description of the tower 26 is in order. To that end the tower, being of conventional construction, includes plural vertically oriented legs 28 supporting the cross bar 24. The tower's structural components can take any suitable form and the embodiment shown herein wherein the legs are formed of angle bar stock (see FIG. 5) is merely exemplary. As is conventional in the electrical power transmission industry the cross bar 24 supports the electrical insulators 24A from which the electrical transmission wires (not shown) are suspended.

The system 20 of this invention basically comprises catapulting means 30, a projectile 32 having a light weight elongated flexible filament 34, secured thereto, the heretofore identified safety rope 22, and plural gate devices 36. Each of those components will be described later. Suffice it for now to state that the catapulting means 30 is arranged to catapult the projectile 32 over the cross bar 24 from the ground 38 so that the filament 34, which is secured to the projectile extends from the ground over the cross bar and back to the ground as shown on the left hand side of FIG. 1.

In accordance with a preferred embodiment of this invention the catapulting means, the projectile and the filament are selected so that the projectile can be catapulted with great accuracy so that the filament is extended over the desired portion of a tall structure, e.g., the transmission tower cross bar 24. One particularly effective catapulting means comprises a conventional air rifle, such as sold by Swivel Machine Works, Inc. of Milford, Conn. under the model designation AIRROW Model A-8Sl1. Other devices for catapulting a small object over a high structure with accuracy may be used in lieu of that air rifle. The projectile 32 may be of any suitable construction and weight, depending upon the distance the projectile is to be propelled and the wind conditions. Two particularly effective projectiles are those sold by the aforementioned company as a "lightweight projectile with a stainless steel nose cone" or a "heavyweight" projectile.

The filament is preferrably of very light weight in the interests of distance and accuracy of projectile placement. One particularly, effective filament is a twisted cord of 150 lb. test.

The leading end 34A of the filament is secured to the projectile by any suitable means (not shown). The trailing end **34*b* of the filament 34 is arranged to be connected, e.g., knotted or secured by any suitable means (not shown) to the leading end 22A of the safety rope 22**.

In accordance with the method of this invention once the projectile 32 has been shot over the cross bar 24 and so that the filament is in place like shown on the left hand side of FIG. 1 the leading end 22A of the rope 22 is secured to the trailing end of the filament 34. It should, of course, be appreciated that the leading end of the rope may be connected to the filament before the projectile is shot over the cross bar. In either case the leading end 34A of the filament can be pulled downward, thereby carrying the rope 22 which is connected to the filament over the cross bar until the leading end 22A of the rope 22 is located adjacent a portion of the transmission tower near the ground, and with a trailing end portion of that rope adjacent that portion (or another closely adjacent portion) of the tower. The filament can then be removed, if desired, and the leading end and the trailing end of the rope can then be secured to that(those) lower portions of the tower as shown on the right side of FIG. 1. For example, as can be seen the leading end 22A of the rope 22 is secured, e.g., looped around and knotted, onto the transmission tower leg portion 28A closely adjacent the ground 38, while the trailing end 22B of that rope is secured, e.g., looped around and knotted, onto a transmission tower portion 28B which is adjacent the leg portion 28A. Preferably the rope is made taut when it is secured to the tower, albeit some slack is shown in FIG. 1.

Once the safety rope 22 has been secured in place on the tower a conventional safety device, e.g., a rope grab 40 (shown in phantom line in FIG. 2) can be mounted thereon and the worker (not shown) secured to the rope grab, e.g., by a conventional lanyard (not shown) and associated harness or safety belt (not shown). The worker may then freely scale up or climb down the tower 26 to perform any work needed to be conducted, without interference by the system and all the while being protected from a fall by the safety line.

In order to hold the safety rope 22 adjacent the tower leg 28 along which it extends, even under very windy conditions, the system 20 includes the heretofore identified gate devices 36. All of the gate devices are of the same construction and are preferably releasably mounted at equidistantly spaced locations along that tower leg 28.

The details of the gate devices will best be understood by reference to FIGS. 2–5. Thus, as can be seen therein each gate device 36 basically comprises a bracket 40 and a gate assembly 42 mounted thereon. The bracket 40 can be of any suitable construction for releasably securing the device onto the tower leg (or some other structural component of the tower adjacent the path along which the worker will move). In the embodiment shown herein the bracket 40 is of a flanged construction comprising a pair of planar plates 44 and 46 disposed perpendicularly to each other so that the bracket can be releasably secured to the right angle bar stock leg 28 of the tower.

In the preferred embodiment shown herein the means for releasably securing the bracket 40 to the tower leg basically comprises an adjustable mounting assembly 48, the details of which will be described later.

The gate assembly 42 is mounted on the bracket and basically comprises a pair of arms 50 and 52 fixedly secured, e.g., welded, to and projecting from the bracket plates 44 and 46, respectively, and a pair of elongated, flexible gate members 56 and 58. As can be seen in FIG. 2 the free ends 50A and 52A of the arms 50 and 52, respectively, are spaced from each other to form a gap 60. The gate members 56 and 58 are elongated strips formed of a resilient material, e.g., spring steel, and are mounted, e.g., welded, on the free ends 50A and 52A of the arms 50 and 52, respectively. The length of the gate members 56 and 58 is selected so that their free ends 56A and 58A, respectively, are immediately adjacent each other when the members are in their normally unflexed condition. In the unflexed condition the gate members 56 and 58 fill the gap 60 between the arms 50 and 52, and the gate assembly can be said to be closed, i.e., the rope held within the confines of the gate assembly as shown by the phantom lines in FIGS. 3–5.

Each gate member 56 and 58, being flexible, is arranged to be flexed from its normal or "closed" position shown by the full lines in FIGS. 2 and 5, to a flexed or "open" position, shown by the phantom lines in FIG. 2, and then to flex back to the closed position. This enables the safety rope to be inserted through the adjacent gate members for securement within the confines of the gate assembly. Moreover, the flexibility of the gate members 56 and 58 enables the rope grab 40 (or any other device mounted for sliding movement along the rope 22) to pass therethrough so that the worker can freely scale up and down the tower without interference by the gate assemblies.

The releasable mounting assembly 48 for the bracket 40 will now be described. That assembly basically comprises a plate 62 and an associated threaded fastener, e.g., bolt 64. The plate 62 is arranged to be slid into and held within a slot formed between a pair of flanged rails 66 bent out of the plane of the plate 44 of the bracket 40. The forward edge 68 of the plate 62 includes a pair of short ears 70 projecting normally from the plane of the plate to prevent the plate from sliding out of the slot between the rails 66. The rear edge 72 of the plate 62 is bent over itself to form a U-shaped slot 74 (FIG. 5) for receipt of the edge of one flange of the angle stock tower leg 28. The bolt 64 is threaded through a hole 76 (FIG. 2) to frictionally engage that tower leg flange between it and the plate 62. The side edge 78 of the plate 46 of the bracket 40 is also bent over itself to form a U-shaped slot 80 (FIG. 5) for receipt of the flange of the tower leg 28. A bolt 82 is threaded through a hole 84 (FIG. 2) to frictionally engage that tower leg flange between it and the plate 46.

As should be appreciated by those skilled in the art the ability of the plate 62 to slide with respect to the bracket 40 enables the bracket to be mounted on flanged tower portions of various dimensions. Moreover, the use of the adjustable bolts 64 and 82 enables the bracket to be slid up or down the tower leg (or other structural component of the tower) to a desired position and then to be secured in place thereat.

Once the worker has completed his/her work the rope can be removed and, if desired the gate devices left in place so that they can be reused at some future time. Alternatively, the gates can be removed by the worker as he/she rappels down from the tower. If conditions are suitable either the filament or the safety line can be left in place over the elevated portion of the tower, to thereby obviate the necessity of propelling the projectile thereover to pull the rope into position.

Without further elaboration, the foregoing will so fully illustrate my invention that others may, be applying current or future knowledge, adopt the same for use under various conditions of service.

I claim:

1. A system for attaching a safety rope to an elevated portion of a tower with said rope extending from said elevated portion to a lower portion of said tower so that a worker may be secured to said rope by a safety device to protect the worker from a fall from said tower, said tower comprising at least one leg extending from adjacent said elevated portion to adjacent said lower portion, said system comprising catapulting means, a projectile having a light weight elongated flexible filament secured thereto, a safety rope, and at least one gate means, said catapulting means being arranged for catapulting said projectile over said elevated structure so that said projectile drops to a position adjacent said lower portion of said tower and said safety rope is coupled to said filament so that said safety rope is extended over said elevated portion and secured in place adjacent said tower leg between said elevated portion and said lower portion, said gate means being mounted on said tower leg and including an openable and closeable gate, whereupon when said gate is opened it releasably receives said safety rope therein and thereafter closes to hold said safety rope in place adjacent said tower leg.

2. The system of claim 1 wherein said catapulting means comprises an air rifle.

3. The system of claim 1 wherein said gate means additionally comprises a bracket for securing said gate means to said tower leg.

4. The system of claim 1 wherein said bracket is releasably securable to said tower leg.

5. The system of claim 3 wherein said bracket comprises a pair of arms projecting outward from said bracket, said gate being located between said arms.

6. A system for attaching a safety rode to an elevated portion of a tower with said rope extending from said elevated portion to a lower portion of said tower so that a worker may be secured to said rope by a safety device to protect the worker from a fall from said tower, said tower comprising at least one leg extending from adjacent said elevated portion to adjacent said lower portion, said system comprising catapulting means, a projectile having a light weight elongated flexible filament secured thereto, a safety rope, and at least one gate means, said gate means comprising a bracket for securing said gate means to said tower leg, said bracket comprises a pair of arms projecting outward from said bracket, each of said arms having a free end, said free ends being spaced from each other to form a gap, with said gate comprising at least one deflectable member located within said gap, said catapulting means being arranged for catapulting said projectile over said elevated structure so that said projectile drops to a position adjacent said lower portion of said tower and said safety rope is coupled to said filament so that said safety rope is extended over said elevated portion and secured in place adjacent said tower leg between said elevated portion and said lower portion, said gate means being securable to said tower leg and including an openable gate for releasable receipt of said safety rope therein to hold said safety rope in place adjacent said tower leg.

7. The system of claim 6 wherein said at least one deflectable member is arranged to be deflected between a closed position in which said member closes said gap to a open position wherein said gap is open.

8. The system of claim 7 wherein said at least one deflectable member comprises a leaf spring.

* * * * *